US007806624B2

(12) United States Patent
McLean et al.

(10) Patent No.: US 7,806,624 B2
(45) Date of Patent: Oct. 5, 2010

(54) PAVEMENT JOINT

(75) Inventors: Peter Charles McLean, Mitcham (AU); Christopher Raymond McClelland, Pearcedale (AU)

(73) Assignee: Tripstop Technologies Pty Ltd, Surrey Hills, Victoria (AU)

( * ) Notice: Subject to any disclaimer, the term of this patent is extended or adjusted under 35 U.S.C. 154(b) by 335 days.

(21) Appl. No.: 11/132,563

(22) Filed: May 19, 2005

(65) Prior Publication Data

US 2005/0276660 A1 Dec. 15, 2005

Related U.S. Application Data

(63) Continuation-in-part of application No. 10/381,289, filed as application No. PCT/AU01/01233 on Sep. 28, 2001, now abandoned.

(30) Foreign Application Priority Data

Sep. 29, 2000 (AU) ..... PR0454

(51) Int. Cl.
*E01C 11/04* (2006.01)

(52) U.S. Cl. ..... 404/47; 52/396.04

(58) Field of Classification Search ..... 404/38, 404/39, 47, 49, 50; 52/396.02, 396.04
See application file for complete search history.

(56) References Cited

U.S. PATENT DOCUMENTS

| | | | | | |
|---|---|---|---|---|---|
| 1,401,590 | A | * | 12/1921 | Del Turco | 404/50 |
| 1,568,012 | A | * | 12/1925 | Walsh | 404/47 |
| 1,655,835 | A | * | 1/1928 | Fischer | 404/50 |
| 1,723,306 | A | | 8/1929 | Sipe | |
| 1,762,682 | A | * | 6/1930 | Fischer | 404/50 |
| RE18,188 | E | * | 9/1931 | Benedict et al. | 404/50 |
| 2,228,052 | A | | 1/1941 | Gardner | 94/18 |
| 2,352,673 | A | | 7/1944 | Westcott | 94/17 |
| 2,716,373 | A | * | 8/1955 | Chollar et al. | 404/50 |
| 2,759,403 | A | | 8/1956 | Kelley | 94/17 |
| 3,023,681 | A | | 3/1962 | Worson | 94/18 |
| 3,061,895 | A | * | 11/1962 | Kleinhans | 277/642 |
| 3,099,110 | A | * | 7/1963 | Spaight | 52/396.09 |
| 3,951,562 | A | | 4/1976 | Fyfe | 404/68 |
| 3,968,611 | A | * | 7/1976 | de Munck | 52/396.02 |
| 3,994,609 | A | | 11/1976 | Puccio | 404/69 |
| 4,041,665 | A | | 8/1977 | De Munck | 52/396 |

(Continued)

FOREIGN PATENT DOCUMENTS

| | | |
|---|---|---|
| CA | 2085066 | 6/1993 |

(Continued)

*Primary Examiner*—Gary S Hartmann
(74) *Attorney, Agent, or Firm*—Baker & Daniels LLP

(57) ABSTRACT

A pavement joint 101, 102 disposed between two contiguous pavement slabs 103, 104 and 105 incorporating a shear key (12, 13, 22 and 23) and at least one hinge (37, 38, 39 and 40). The shear key and the at least one hinge are operative when at least one of the slabs is subjected to out-of-plane action P with the shear key transferring shear between the slabs, and the at least one hinge accommodating angular displacement of the slabs relative to the joint axis in at least one direction. In one form, a joint member 10, 20, 40, 50 and 60 is disposed between the slabs to provide the shear key and hinge. A joint member and pavement slab for use in the joint is also described.

23 Claims, 11 Drawing Sheets

U.S. PATENT DOCUMENTS

| | | | | | |
|---|---|---|---|---|---|
| 4,080,086 | A | | 3/1978 | Watson | 404/69 |
| 4,098,047 | A | | 7/1978 | Weber | 52/741 |
| 4,453,360 | A | * | 6/1984 | Barenberg | 52/396.04 |
| 4,599,841 | A | * | 7/1986 | Haid | 52/396.04 |
| 4,622,784 | A | | 11/1986 | Black et al. | 52/2 |
| 4,740,404 | A | | 4/1988 | Otsugu et al. | 428/44 |
| 4,752,153 | A | | 6/1988 | Miller | 404/59 |
| 4,916,878 | A | | 4/1990 | Nichols | 52/396 |
| 5,088,256 | A | | 2/1992 | Face, Jr. | 52/396 |
| 5,910,087 | A | | 6/1999 | Carter | 52/371 |
| 6,014,849 | A | * | 1/2000 | Yonemura | 52/586.1 |
| 6,052,960 | A | * | 4/2000 | Yonemura | 52/393 |
| 6,276,106 | B1 | * | 8/2001 | Shotton et al. | 52/396.02 |
| 6,471,441 | B1 | | 10/2002 | Muller | 404/62 |
| 2003/0190190 | A1 | | 10/2003 | McLean | |

FOREIGN PATENT DOCUMENTS

| | | |
|---|---|---|
| DE | 25 42 357 | 3/1977 |
| DE | 299 06 093 | 7/1999 |
| DE | 299 06 093 | 9/1999 |
| DE | 25 42 357 | 5/2008 |
| EP | 0 553 723 | 8/1993 |
| FR | 2 602 253 | 2/1988 |
| JP | 10-80230 | 3/1998 |
| JP | 10-183505 | 7/1998 |
| WO | WO 94/11579 | 5/1994 |
| WO | 99/31329 | 6/1999 |

* cited by examiner

PAVEMENT JOINT

RELATED APPLICATION

The present application is a continuation in part application of U.S. application Ser. No. 10/381,289 filed 22 Apr. 2003 now abandoned, which is related to and claims the benefit under 35 U.S.C. §119 and 35 U.S.C. §365 of International Application No. PCT/AU2001/01233, filed Sep. 28, 2001, the contents of which are herein incorporated by cross reference.

FIELD OF THE INVENTION

The present invention relates generally to the construction of pavements and to jointing systems for use in such pavements. The invention has particular application to pavements that are susceptible to differential movement by out-of-plane action such as for example by tree root invasion, or soil movement, and which usually bear traffic that can accept some irregularity in the pavement surface and the invention is herein described in that context.

BACKGROUND OF THE INVENTION

Pavements are used to facilitate the passage of wheeled or pedestrian traffic along or over roads, footpaths (sidewalks), playgrounds, and areas used for storage or parking. To do its job well, such a pavement should be relatively smooth and flat. For reasons of economy, such pavements are often cast in substantial lengths, with construction joints between them. However, in some forms, pavements may be formed from preformed slabs made from a settable material, such as concrete, or formed from other rigid material such as steel or wood. Footpaths are pavements that carry relatively light, low speed traffic such as pedestrians and pedestrian vehicles such as wheelchairs, strollers and bicycles. Other categories of light duty pavement include cycle ways, domestic driveways, playgrounds and the like. These pavements generally do not need to be as smooth or flat as those used to carry heavy or high speed traffic.

A pavement is subject to both direct and indirect actions. Direct actions include traffic loads and forces deriving from soil or foundation movement, and tree roots. In the case of footpaths, cycle ways and domestic driveways for example, which are frequently built alongside trees, uplifting actions caused by tree roots are common. Uplifting or depressing actions can be seen as out-of-plane, relative to that of the pavement.

Indirect actions include drying (moisture) and temperature change. When a pavement is made from concrete, these actions cause both temporary and permanent volumetric changes that manifest in the form of expansion and contraction. Shrinkage, which is caused by drying, can be seen in this sense as a form of permanent contraction. The effect of these actions is most significant in the plane of the pavement. For example, the unrestrained drying shrinkage of concrete is commonly in the order of 800 micro strain or 1.2 mm for a slab 1500 mm long. The coefficient of thermal expansion of concrete is commonly in the order of 12 micro strain per degree Celsius or approximately 0.4 mm in a slab 1500 mm long subjected to a temperature change of 20 deg. C. If contraction is restrained, it may lead to cracking of the concrete. If expansion is restrained it may lead to any or all of spalling and crushing of the concrete and buckling and warping of the pavement.

Commonly, provision for contraction of concrete pavements is made by incorporating contraction joints at relatively close intervals effectively dividing the pavement into a series of contiguous slabs. In the case of an un-reinforced concrete pavement such as a footpath, for example, contraction joints are commonly spaced at between 15 and 20 times the thickness of the pavement. For a 75 mm thick pavement, this implies joints at 1000 to 1500 mm. Provision for the expansion of concrete pavements, which are subjected to solar heating, such as roads and footpaths, is made by incorporating expansion joints, also known as isolation joints, at relatively wide intervals, commonly 4 to 5 meters. Thus external pavements commonly take the form of a series of contiguous slabs, both separated and linked by a combination of contraction and expansion joints.

For reasons of economy, contraction joints are commonly formed by creating a plane of weakness in the top surface of the concrete, by trowelling grooves in the fresh concrete or cutting grooves in the partially or fully hardened concrete. This encourages cracking to occur at such grooves rather than in a random fashion, which would be unsightly, and helps to create many narrow cracks rather than few large cracks, which would be detrimental. In practice, the effectiveness of this method is subject to variations in the concrete, in the friction between the pavement and the soil or subgrade upon which it rests, workmanship, climatic conditions and other factors, and contraction often accumulates over two or more slabs so that cracks do not occur at some planes of weakness and relatively wide cracks occur at others.

Localised direct actions such as uplifting caused by tree roots or soil heave cause flexural stresses in the pavement. In the case of un-reinforced concrete footpaths for example, which have relatively closely spaced contraction joints, the uplifting action of a tree root will typically lead to the opening or creation of a crack emanating from the top surface of the footpath at a contraction joint adjacent to the point of uplifting. However, the cracking of this construction joint only reduces the flexural strength of a slab significantly in one direction and the aforementioned lifting may lead to the sudden, uncontrolled fracture of the footpath at distances from the point of lifting corresponding to the flexural strength of the concrete. Further, if a crack is relatively wide, a lifted slab may not engage its neighbour with the result that a vertical discontinuity or step will be created in the pavement. In the case of footpaths this often leads to steps of sufficient height to impair the passage of pedestrian vehicles and to cause pedestrians to trip or fall.

Expansion joints usually consist of a sheet of compressible material extending the full thickness of a pavement so as to allow the pavement to expand without inducing excessive compressive stresses in the concrete from which the pavement is made, which could lead to crushing or spalling of the concrete or warping or buckling of the pavement. Such joints have no ability to transfer load or to limit differential displacement within a pavement.

SUMMARY OF THE INVENTION

In a first aspect the present invention provides a pavement joint disposed between two contiguous pavement slabs, the joint being elongate and extending along a joint axis and incorporating a shear key and at least one hinge, the shear key and the at least one hinge being operative when at least one of the slabs is subjected to out-of-plane action with the shear key transferring shear between the slabs, and the at least one hinge accommodating angular displacement of the slabs relative to the joint axis in at least one direction.

In the context of the specification, the term "pavement" relates to any hard surface especially of a public area or thoroughfare that will bear travel. Further, the pavement slabs may be formed from any suitable material and may be formed as precast units or cast in-situ. Examples of pavement slabs include, concrete slabs, hard and rigid materials like concrete, slabs formed from timber, or metal, such as expanded metal mesh, or from any combination of those materials.

In accordance with the invention, the joint provides a load transfer mechanism that inhibits differential vertical movement of the slabs when at least one of those slabs is affected by an out-of-plane action such as by tree root invasion or by soil movement. By reducing the differential vertical movement of the contiguous slabs, potential tripping hazards to pedestrians are reduced. Along with this, as pavements are less likely to require repair or replacement, there is a future cost saving to users and a reduction in waste of resources.

In general, this load transfer mechanism is provided by the shear key. The shear key provides a means of transferring or equalising vertical displacement between the slabs and may take many different forms to affect that transfer. The at least the one hinge provides a means of accommodating angular displacement relative to the joint axis so as to provide a mechanism whereby the pavement may articulate to relieve stress induced by the out-of-plane action.

The inventors have found that the magnitude of angular displacement that needs to be accommodated in pavements that are subjected to localised actions from tree roots and the like and which are comprised of relatively short slabs, is an order of magnitude greater than that required in other pavements such as roads. For example, a tree root may lift one end of a footpath slab by 25 mm to 50 mm which implies, for a 1500 mm long slab, a rotation of 1° to 2°. This level of rotation may be accommodated by the joint according to the present invention through the at least one hinge whereas such rotation could not be accommodated by a conventional contraction joint. However, it is to be appreciated that the out-of-plane action may result from other than specific localised action. For example, this action may result from ground subsidence, or even from more violent action such as earth tremors and the like.

In a particular embodiment, the joint may be formed through interengagement of the respective edge surfaces of the slabs. In that arrangement, the edges are profiled to form, by the interengagement, the shear key and the at least one hinge.

In one form, the shear key is provided by at least one portion of the edge surface of one slab locating within a recess formed in the other edge surface so that shear is able to be transferred across that connection. In one form, a tongue and groove connection is formed between the contiguous slabs.

In the arrangement where the joint is formed at least substantially from the profile of the edge surfaces of those slabs, the mechanism used in the hinge to enable angular displacement may take various forms. In one embodiment, each slab may have a bearing surface along its edge surface with the interengagement of those bearing surfaces providing a hinge of the joint.

The bearing surface may be formed from an exposed edge surface of the slabs. Alternatively a covering such as a metal or polymeric skin, film or the like may extend over that edge surface to form the bearing surface. The advantage of using such a covering may be to improve the surface properties of the bearing surface, or to increase the joint strength or to facilitate manufacture of the joint.

In one form, one bearing surface may be able to slide within another bearing surface so that the hinge action is by sliding rotation.

In another form, the ends of the slab may have a cross section akin to that of gear teeth, so as to enable shear to be transferred in the manner of gear teeth, and rotation to be accommodated by rolling, in the manner of a gear wheel.

When a slab of finite thickness rotates, say from a horizontal plane, it initially lengthens in plan. This means that when a slab is lifted close to one end and lifts its adjacent slab, the joint between the slabs opens at the top and closes at the bottom, and the joint between the slabs and their non-lifted adjacent slab close at the top and open at the bottom.

Typically in use, the lifted slabs are prevented from moving horizontally by their non-lifted adjacent slabs. As such, because of this lengthening effect compressive stresses may be induced in both the lifted and the non-lifted slabs unless there is some facility to accommodate this lengthening or at least minimising its affect. Typically, the result of this lengthening is that a pinching effect may occur between the slabs as they are angularly displaced. This effect may be offset by shrinkage in certain circumstances where the slabs are formed from concrete or similar material. In other circumstances, the joint between the slabs needs to accommodate the lengthening effect so that there is not undue stress occurring at the joint which would cause failure of at least one or more of the slabs.

In the arrangement as described above where the slabs may be akin to gear wheels, if the radii of the slab ends are established to equal the distance from the contacting surface to the fulcrum about which the slabs rotate, the pinching effect described above is obviated.

In one form, the joint may include at least two hinges, with one hinge allowing angular displacement about the joint axis in one direction whereas the other hinge allowing angular displacement of the joint axis in an opposite direction. In one form, these hinges are displaced towards a respective outer surface the slabs. In one form, each of these hinges use a hinge action of sliding rotation with each hinge being formed from cooperating arcuate bearing surfaces that slide one within the other.

In one form, the joint includes only a single hinge which is disposed on or about the neutral axis of the slabs. When located in that position, the relative lengthening of the slabs that occurs during rotation needs to be accommodated. In one form this may be accommodated by incorporating sufficiently sized gaps within the joint at the outer margins of the slab so as to allow adequate clearance for the slab to rotate through a predetermined angular displacement (typically less than 5° and more typically less than 3°). However depending on the thickness of the slab, the gap required may be excessive and may in fact cause a tripping hazard to the pavement. As such, in another form, the joint may include a compressible member disposed between the contiguous slabs and arranged to accommodate the lengthening of the slabs under the angular displacement.

In a particular embodiment, the pavement slabs may be pre-formed and the compressible members may be fixed to one or both of the slabs prior to installation or located within the joint on interconnection of the respective slabs.

In a particular embodiment, the pavement joint incorporates a joint member.

In one form, where the contiguous slabs are cast in-situ, this joint member may act as formwork for both of the pavement slabs. In one form, the joint member may be formed from a sheet material such as sheet steel and if necessary may include other elements such as the one or more compressible members mounted thereon. The joint member in this form may be fixed to one of the slabs so that the joint hinge is formed through engagement of a surface of the joint member and the other slab to which that joint member is connected.

In one form, the shear key of the joint is provided by interengagement of the contiguous slabs with the joint member. In a particular embodiment, the joint member incorporates opposite lateral portions that extend into respective ones of the slabs so as to locate the jointing member within the slab sufficiently to enable shear to be transferred across the contiguous slabs through said jointing member.

In one form, at least one of the lateral portions is profiled to incorporate an arcuate surface. In this arrangement, the at least one lateral portion forms part of the hinge that operates by sliding rotation with the arcuate surface forming a bearing surface of that hinge.

In the arrangement where the joint includes a joint member, in that particular embodiment, the joint member may be formed of a suitable material that allows it to deform or flex with the hinge action of the at least one hinge of the joint being through this deformation or flexing of the joint member. In this way, a live hinge is formed in the joint.

In one form, the joint member, whilst being able to deform or flex, maintains sufficient rigidity and is secured within the slabs so that the joint member is still able to act as a shear key to transfer shear through the joint.

In a particular embodiment, the lateral portions are able to be angularly displaced relative to the joint axis so as to provide the joint hinge.

In a particular embodiment, the joint member includes a core and the lateral portions extend outwardly from the core and are spaced apart about the joint axis through approximately 180°. With this arrangement, one lateral portion projects into one slab, whilst the other lateral portion projects into the other slab.

In one arrangement, the joint member also includes at least one spacer that projects from the core. The at least one spacer locates between the contiguous slabs and is angularly spaced about the joint axis from the lateral portions.

In a particular embodiment, the joint member includes two spacers which are angularly spaced apart about the joint axis through approximately 180°. In a particular embodiment, the joint member is configured so that the spacers extend generally in a direction which is substantially perpendicular to the lateral portions. However, it is to be appreciated that the configuration of the joint member may vary so that the spacers are not at right-angles to the lateral portions.

The spacers of the joint member may be incorporated to accommodate the effects of lengthening of the at least one slab on angular displacement of the slabs about the at least one hinge. In this way, the spacers may be made from a material which is able to be compressed to at least some extent to accommodate this lengthening effect.

In a further form, the joint member may be arranged so that it completely separates and links the contiguous slabs. In this arrangement, the joint member includes two spacers that project from the core and extend to a respective one of the outer surfaces of the slabs. In this arrangement, the spacers may be sufficiently compressible so as to provide an expansion joint for the pavement to accommodate in-plane expansion of the slabs.

The configuration of the joint member with the core, lateral portions, and two spacers may incorporate a hinge action that operates either through deformation or flexing of the joint member or alternatively through an arrangement where there is sliding or rolling rotation between a bearing surface of the joint member and a corresponding bearing surface formed on the edge of abutting slab.

In a particular embodiment of the above form of joint member, the joint member is formed with a plurality of bearing surfaces, each of which cooperate with a corresponding bearing surface on its opposing slab so as to form a plurality of hinges within the pavement joint.

In one form, at least one face of the joint member includes two hinge bearing surfaces, these bearing surfaces extending from a distal end of the lateral portion of the joint member to a respective distal end of the spacers. In a particular form, these bearing surfaces are concave.

In one form, the joint member includes a pair of hinges of the above type on each of its opposite faces. Therefore in this arrangement, the joint member incorporates four (4) concave bearing surfaces each of which are part of a hinge of the joint.

In a particular embodiment, the joint member is elongate having a constant cross-section. In a particular form, the joint member is formed in continuous lengths typically by an extrusion process.

In one form, the joint member is formed from a polymeric material, such as PVC, HDPE, EPDM, or a high hardness rubber. In an alternative embodiment, the joint member from metal such as aluminum or made of composite construction, such as a steel reinforced polymeric material.

In a further aspect, the invention relates to a joint member for a pavement joint, the joint member having a joint axis and being arranged to be disposed between contiguous pavement slabs, the joint member comprising opposite first and second faces that in use oppose respective ones of the edge surfaces of the slabs, the first face incorporating a lateral portion that projects outwardly from the face and is arranged to inter-engage with an edge surface of its opposing slabs so as to enable shear to be transferred from that slab to the joint member, and a hinging portion that forms at least part of the at least one hinge of the pavement joint for accommodating angular displacement of the slabs relative to the joint axis in at least one direction.

In one form, the hinging portion comprises at least one bearing surface that engages with a bearing surface of its opposing slab and wherein the inter-engagement of those bearing surfaces provides the at least one hinge of the joint.

In a particular embodiment, the second face also incorporates a lateral portion that projects from that face and is able to inter-engage with an edge surface of its opposing slab so as to enable shear to be transferred between that slab and the joint member. In one form, both the first and second faces incorporate two bearing surfaces disposed on respective opposite sides of the lateral portions disposed on that face, the bearing surfaces being arranged to engage with respective bearing surfaces of the edge surfaces of the opposing slabs to form four hinges of the joint.

In yet a further aspect, the present invention provides a method of inhibiting differential out-of-plane movement of contiguous slabs in a pavement under an out-of-plane action applied to at least one of the slabs by incorporating pavement joints between the contiguous slabs, the joints being elongate and each extending along a joint axis and being capable of transferring shear between the slabs and accommodating angular displacement of the slabs relative to the joint axis in at least one direction.

In yet a further aspect, the invention relates to a pavement slab that incorporates at least one profiled end surfaces which in use form a part of a joint with a contiguous pavement slab to allow shear to be transferred across the joint and angular displacement of the slabs is accommodated. In one form, a joint member is disposed between the slabs.

BRIEF DESCRIPTION OF THE DRAWINGS

It is convenient to hereinafter describe embodiments of the present invention with reference to the accompanying drawings. It is to be appreciated that the particularity of the drawings and the related description does not supersede the generality of the preceding broad description of the invention.

In the drawings.

DETAILED DESCRIPTION

Figure 1:
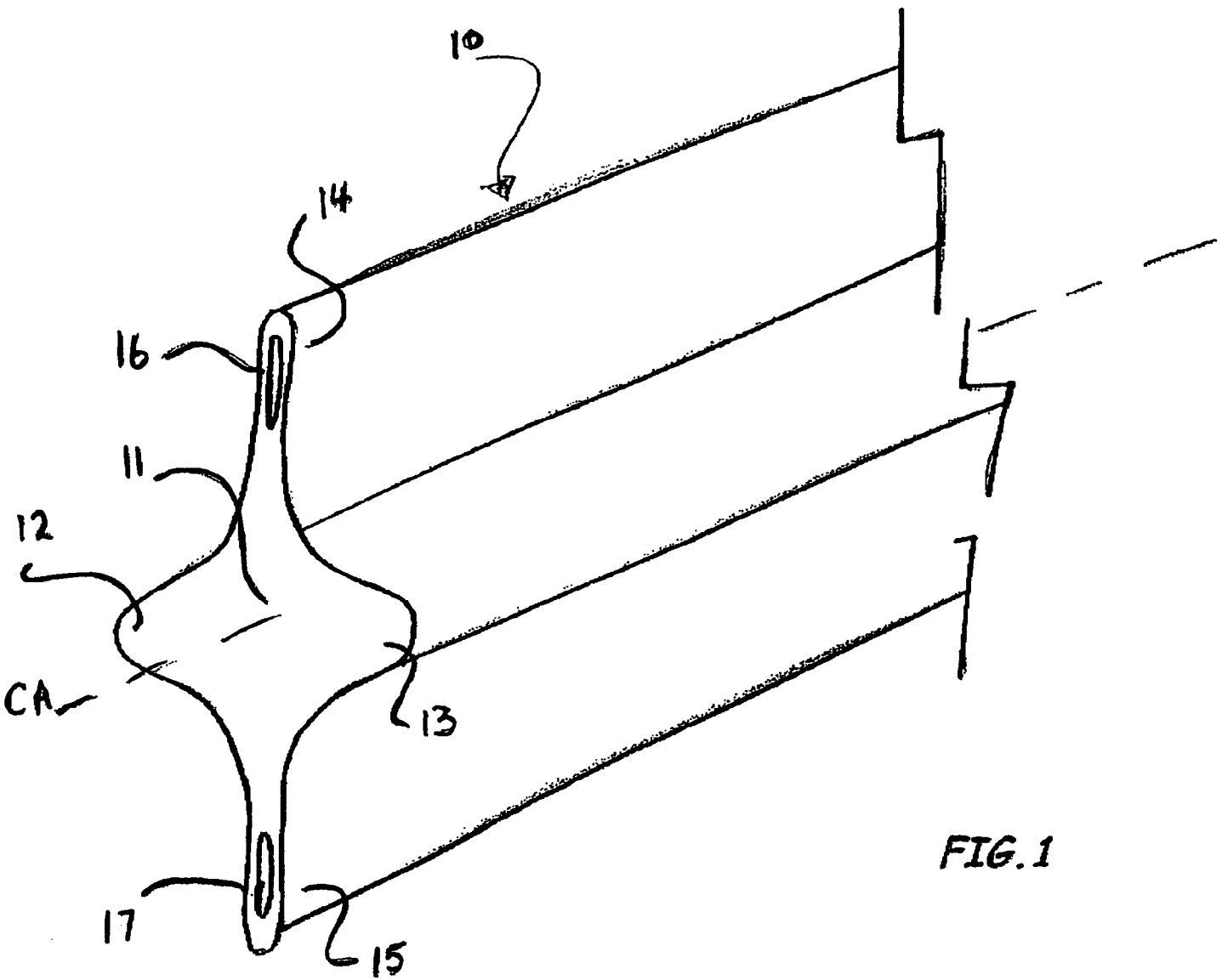
FIG. 1 is a perspective view of a joint member according to a first embodiment.
Figures 2, 3:
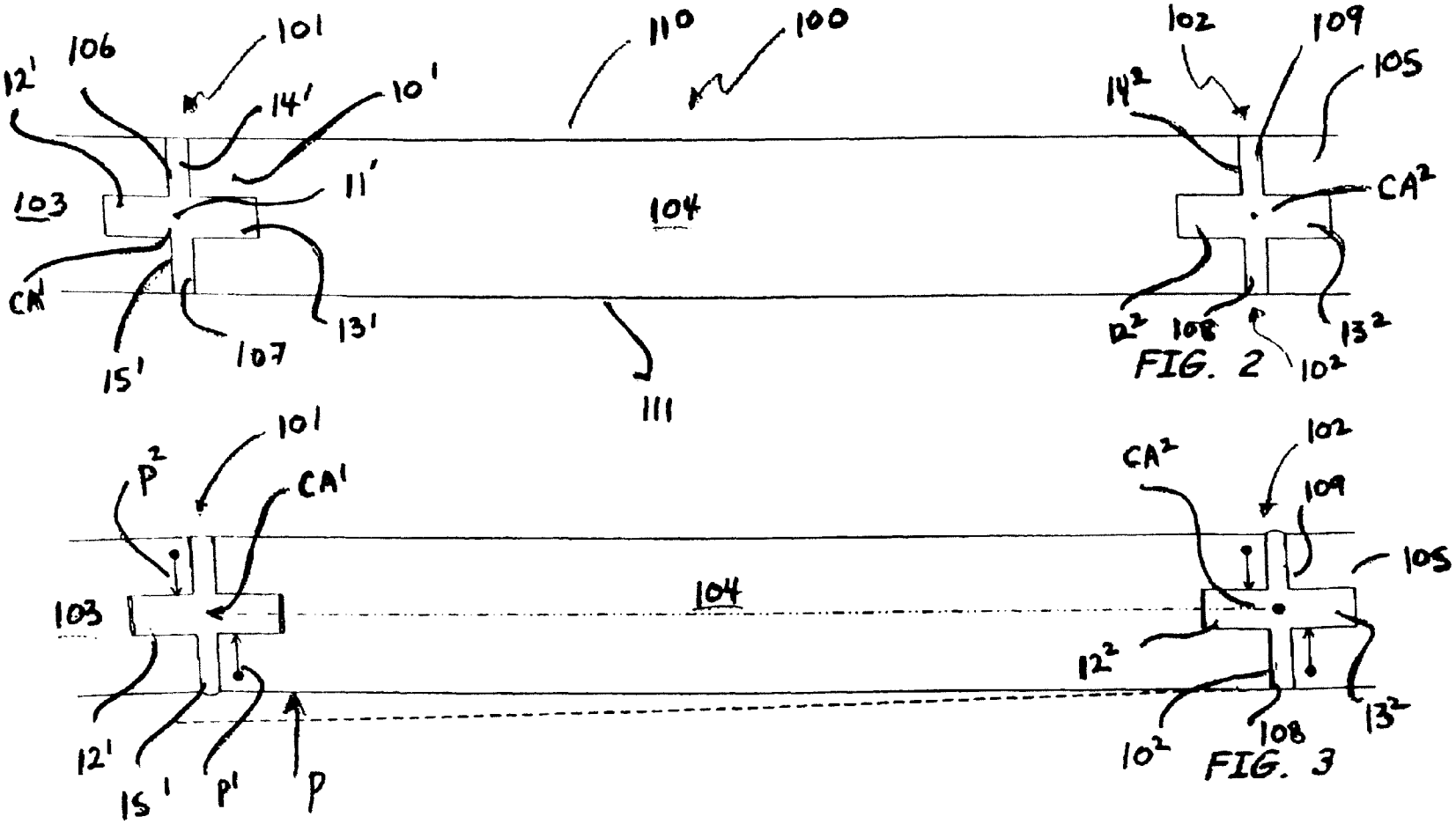
FIG. 2 is a schematic elevation view of a pavement having joints incorporating the joint member of FIG. 1.
FIG. 3 is the pavement of FIG. 2 when subjected to an out-of-plane action.

FIG. 1 illustrates a joint member 10 for use in the joints 101, 102 of a pavement 100 (see FIG. 2). The joint member 10 is elongate and extends along a joint axis CA. The member is formed from a polymeric material such as EPDM (Ethylene Propylene Dieme Monomer), typically from an extrusion process.

The joint member 10 incorporates a core 11, lateral portions 12 and 13 which extend outwardly from the core and which are angularly spaced apart about the axis CA by about 180° so is to extend on opposite sides of the core. The joint member also include spacers 14 and 15 that project from the core. These spacers 14 and 15 are also spaced apart approximately through 180° about the core and are also generally at right angles to the lateral portions 12, 13, giving the joint member a cross-section that is similar to a crucifix. In the illustrated form, the spacers are thinner than the lateral portions 12 and 13 and also incorporate cavities 16 and 17 that extend along the joint. The purpose of these cavities is to increase the ability of the spacers 14, 15 to be able to compress.

FIGS. 2 and 3 illustrate a concrete pavement 100 formed from contiguous slabs 103, 104, 105 and having pavement joints 101, 102. The pavement joints 101 and 102 incorporate joint members 10. For convenience, references to these joint members are given the superscript 1, or 2, with features of those joint members given similar designations. Also, the joint members 101, and 102 disclosed in FIGS. 2 and 3 incorporate a modified profile to better illustrate the principles of operation of the pavement joints 101, and 102.

In the illustrated form, the pavement 100 is formed by casting the slabs 103, 104, 105 over the joint members $\mathbf{10}^1$, $\mathbf{10}^2$. In this way, the joint members both link and separate the slabs 103, 104 and 105. Specifically, the lateral portions $\mathbf{12}^1$, $\mathbf{13}^1$, $\mathbf{12}^2$ and $\mathbf{13}^2$ are embedded into the edge surface 106, 107, 108 and 109 of respective slabs 103, 104 and 105 whilst the spacers $\mathbf{14}^1$, $\mathbf{15}^1$ and $\mathbf{14}^2$, $\mathbf{15}^2$ separates the slabs 103, 104 and 105, with the spacers of the respective slabs extending to the outer surfaces of the pavement 110, 111.

In general, a pavement is subject to both direct and indirect actions. Direct actions include traffic loads and forces deriving from soil or foundation movement, and tree roots. In the case of footpaths, cycle ways and domestic driveways for example, which are frequently built alongside trees, uplifting actions caused by tree roots are common. Uplifting or depressing actions can be seen as out-of-plane, relative to that of the pavement.

Indirect actions include drying (moisture) and temperature change. When a pavement is made from concrete, these actions cause both temporary and permanent volumetric changes that manifest in the form of expansion and contraction. Shrinkage, which is caused by drying, can be seen in this sense as a form of permanent contraction. The effect of these actions is most significant in the plane of the pavement. For example, the unrestrained drying shrinkage of concrete is commonly in the order of 800 micro strain or 1.2 mm for a slab 1500 mm long. The coefficient of thermal expansion of concrete is commonly in the order of 12 micro strain per degree Celsius or approximately 0.4 mm in a slab 1500 mm long subjected to a temperature change of 20 deg. C. If contraction is restrained, it may lead to cracking of the concrete. If expansion is restrained it may lead to any or all of spalling and crushing of the concrete and buckling and warping of the pavement.

Commonly, provision for contraction of concrete pavements is made by incorporating contraction joints at relatively close intervals effectively dividing the pavement into a series of contiguous slabs. In the case of an un-reinforced concrete pavement such as a footpath, for example, contraction joints are commonly spaced at between 15 and 20 times the thickness of the pavement. For a 75 mm thick pavement, for example this implies joints at 1000 to 1500 mm. Provision for the expansion of concrete pavements, which are subjected to solar heating, such as roads and footpaths, is made by incorporating expansion joints, also known as isolation joints, at relatively wide intervals, commonly 4 to 5 meters. Thus external pavements commonly take the form of a series of contiguous slabs, both separated and linked by a combination of contraction and expansion joints.

In the embodiment illustrated in FIG. 2, the joints 101, and 102 form the contraction joints for the pavement 100. However, unlike conventional contraction joints, the joints 101 and 102 are able to accommodate out-of-plane action, typically by tree root invasion or by soil heave so as to inhibit differential vertical movement of the slabs. The mechanism by which the joints accommodate this action is best explained with reference to FIG. 3.

FIG. 3 illustrates the pavement 100 displaced after the application of an out-of-plane action P, such as may occur through tree root invasion under slab 104.

Following, the application of the force P to the slab 104, the load in that slab is transferred both to slab 103 and to slab 105 through their respective joints 101, 102. In particular, in relation to the joint 101, the slab 104 applies loading to the lateral portion $\mathbf{13}^1$ as represented by the arrow $p^1$ and a reaction force $p^2$ is induced in the other slab 103 at the top of the lateral portion $\mathbf{12}^1$. As such, the core 11' and the lateral portions $\mathbf{12}^1$ and $\mathbf{13}^1$ of the joint member $\mathbf{10}^1$ form a shear means that transfers shear between the slabs 103, 104 across the joint 101.

If the load P is of significant magnitude, the slab 104 will lift. This lifting action will reduce the magnitude of the load and as such, the slab will continue to lift until such time as an equilibrium position is reached. The ability for the slab to lift is provided by the hinge mechanisms incorporated in the joints 101, 102. As such, the threshold load under which the slab 104 will lift is in part a function of the resistance provided to rotating through the joints 101, 102, particularly as shear is able to be transferred to adjoining slabs so that individual slabs are not free to lift independently of one another.

To enable the slabs of the pavement 100 to rotate, the lateral portions of both joint members 101, 102 are able to flex thereby constituting hinging means so that those portions are angularly displaced about their respective joint axes $CA^1$, $CA^2$. This rotation causes a closing up of the gap between the slabs 103, 104 at the lower edge of the joint 101 and a closing up of the gap between the slabs 104, 105 at the upper end of the joint 102. Conversely, the gap at the upper end of the joint 101 opens up whereas the gap at the lower end of the joint 102 opens up.

The joint member spacers 14, 15 are designed to accommodate the closing up of the gap. Specifically, as mentioned above these spacers are compressible to some extent so that as the gap closes up at the respective joints 101, 102 this lengthening effect of the slab 102 is accommodated by compression of the spacers 151 and 142.

Accordingly, under this operation the pavement 100 through the action of the hinging means effectively articulates about its respective joints so as to accommodate the out-of-plane action. Through this articulation movement there is effectively no vertical movement experienced at the joints 101, 102 between the adjoining slabs other than that due to shear deflection of the lateral portions of both joint members. Also there is no damage to the slabs because the joints 101 and 102 are able to accommodate the rotation which effectively relieves the stress induced by out-of-plane action P.

Figure 4:
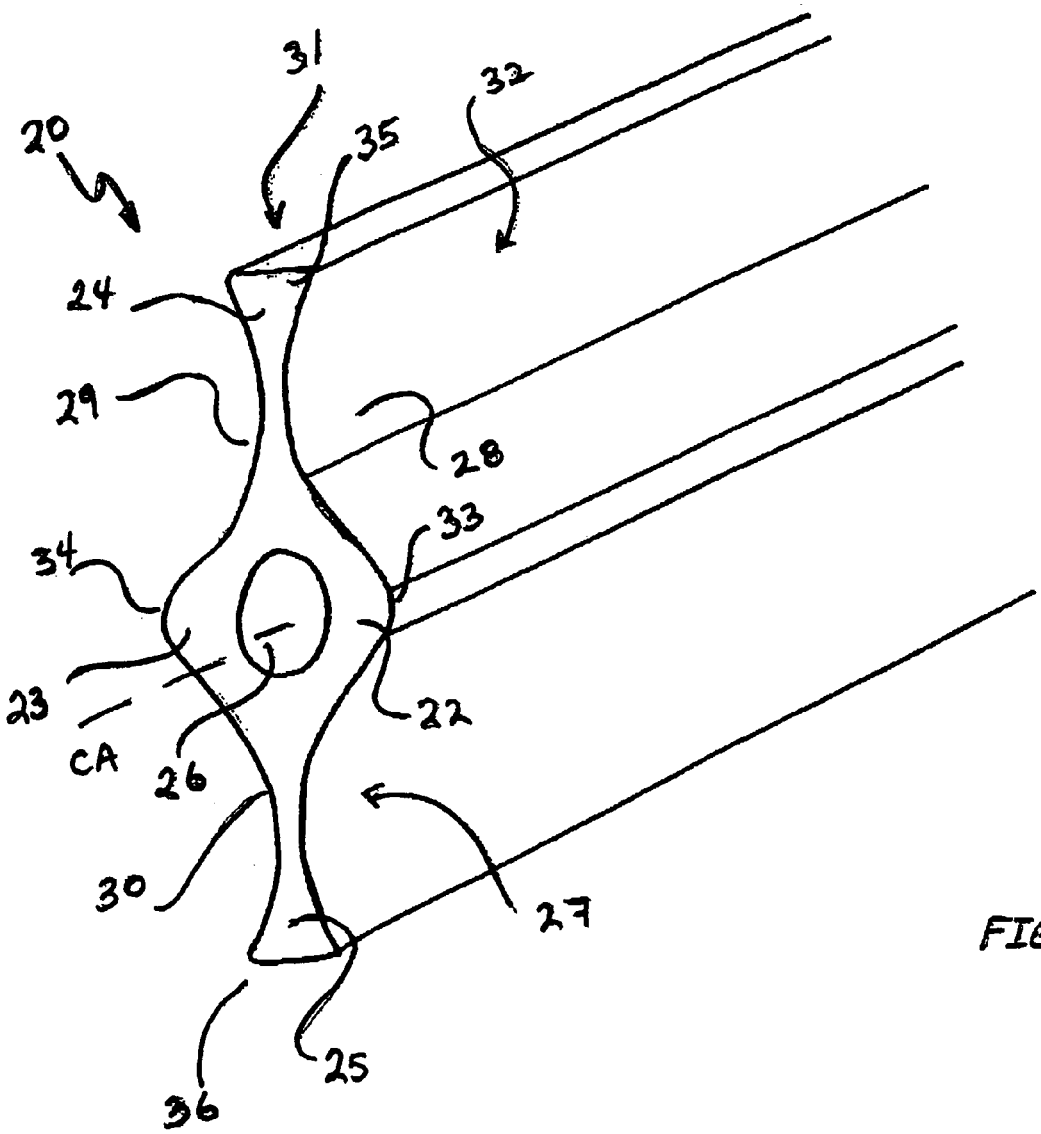
FIG. 4 is a perspective view of a joint member according to a second embodiment.

FIG. 4 illustrates a variation of the joint member 10. The joint member 20 disclosed in FIG. 4 is arranged to be used in pavement joints 101, 102 (see FIG. 5 and FIG. 6) in a similar way to that of joint member 10. In particular, the joint member 20 allows shear to be transferred through the joints 101, 102 to the adjoining slabs and to accommodate angular displacement of those slabs about the joint axes $CA^1$ and $CA^2$. However, a different mechanism is used to accommodate the angular displacement as it is described in more detail below.

In a similar manner to the earlier embodiment, the joint member 20 incorporates a core 21, and lateral portions 22 and 23 forming shear means, the lateral portions 22 and 23 extend outwardly from the core and are angularly spaced apart about the axis CA by about 180° so as to extend on opposite sides of the core. The joint member also includes spacers 24 and 25 that project from the core. These spacers 24 and 25 are also spaced apart approximately through 180° about the core and also generally are at right angles to the lateral portions 22, 23 again giving the joint member 20 a cross-section that is somewhat akin to a crucifix.

In a similar manner to the earlier embodiment, the joint member 10 is elongate and typically formed from an extrusion process. However in contrast to the earlier embodiment where the joint member was made from a deformable material (such as EPDM), the joint member 20 is of rigid construction and is formed from a suitable material such as PVC. In addition, in the illustrated form, the joint member includes a central cavity 26 which facilitates extrusion and which may be filled by another extrusion if required with the joint member being made by a co-extrusion process.

Because of its rigid construction, the joint member is not able to accommodate angular displacement of the slabs about the joint axis CA by flexing or deformation of the joint member which would otherwise enable the lateral portions 22 and 23 to be angularly displaced relative to one another. In contrast, in joint member 20 this angular displacement is accommodated by relative movement of the pavement slabs about the joint member.

To allow this movement, the joint member 20 incorporates a plurality of bearing surfaces 27, 28, 29 and 30 forming hinging means. Two of the bearing surfaces 27, 28 are disposed on one face 31 of the joint member 20 whereas the other two bearing surfaces 29 and 30 are disposed on the opposite face 32 of the joint member. Furthermore, the bearing surfaces are arranged so that on any one face, those bearing surfaces are disposed on opposite sides of the lateral portions 22 and 23. With this arrangement, the bearing surfaces of one face are arranged to inter-engage with corresponding bearing surfaces disposed on the edge surface of its opposing slab. These respective inter-engaging surfaces each provide the hinging means (37, 38, 39, 40) in the pavement joint 101 and 102.

As best illustrated in FIG. 4, the respective bearing surfaces extend substantially from a distal end 33, 34 of the respective lateral portions 22, 23 to a respective one of the distal ends 35, 36 of the spacers 24 and 25. Furthermore, each of the bearing surfaces are arcuate (being concave). In particular, the arcuate surfaces are shaped so that the action of the respective hinges (37, 38, 39, 40) formed by inter-engagement of the bearing surfaces with corresponding bearing surfaces in the pavement slabs is one of sliding rotation. This will be discussed in more detail below with reference FIGS. 5 and 6.

Figure 5:
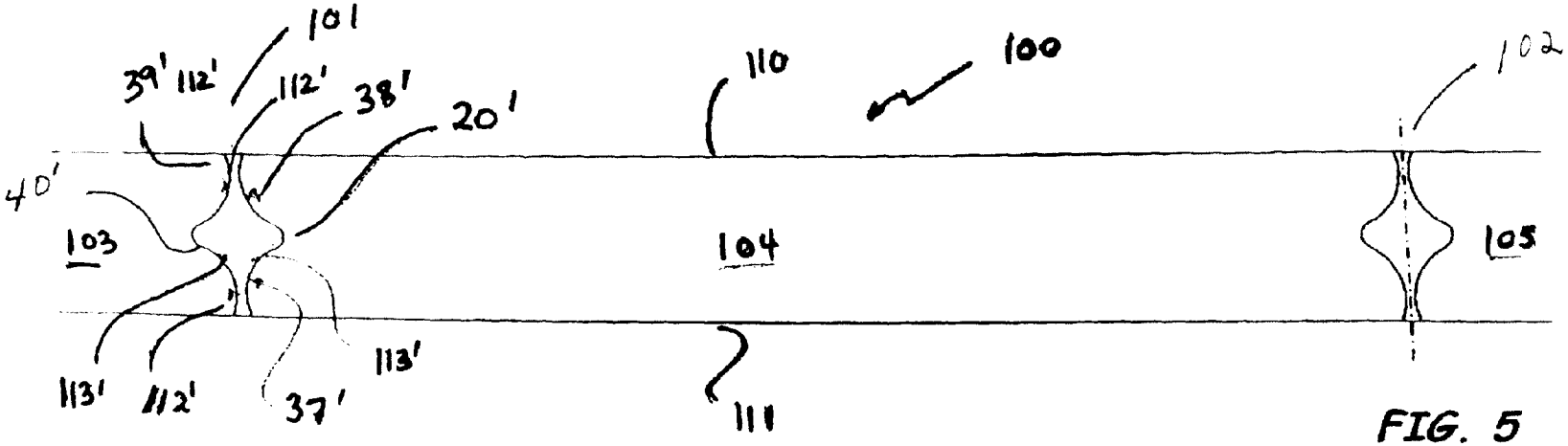
FIG. 5 is a schematic elevation view of a pavement having joints incorporating the joint member of FIG. 4.

In a similar arrangement to the earlier embodiment, FIG. 5 illustrates a concrete pavement 100 formed from contiguous slabs 103, 104, 105 and having pavement joints 101, 102. The pavement joints 101 and 102 incorporate joint members 20. For convenience, reference to these joint members are given the superscript 1, or 2, with the features of those joint members given similar designations.

In the illustrated form, the pavement 100 is formed by casting of the slabs 103, 104 and 105 across the joint members $\mathbf{20}^1$, $\mathbf{20}^2$. In this way, the joint members both link and separate the slabs 103, 104 and 105. Specifically, the lateral portions $\mathbf{22}^1$, $\mathbf{23}^1$, $\mathbf{22}^2$, $\mathbf{23}^2$ are embedded into the edge surface of respective slabs 103, 104 and 105 whilst the spacers $\mathbf{24}^1$, $\mathbf{25}^1$, $\mathbf{24}^2$ and $\mathbf{25}^2$ separates the slabs 103, 104 and 105 with the spacers extending to the respective slab surfaces 110, 111 of the pavement 100.

As illustrated in FIG. 5, the end surfaces of the slabs 103, 104 and 105 are cast onto respective ones of the faces and as a result, each of those end surfaces are formed with arcuate bearing surfaces 112, 113 which correspond to respective ones of the bearing surfaces 27, 28, 29 and 30 of the joint member 20 (FIG. 4).

The bearing surfaces of the joint member 20 are designed to be smoothly curved and in one form, the curve has a constant radius so as to form a hinge which operates by sliding rotation of the inter-engaging surfaces. This surface profile allows good even respective load distribution across the hinges. In one form, the shape of the bearing surfaces on the joint member is such that there is a change in radius. The purpose of this change of curvature enables the effective point at which the pinching force is applied to one lifted slab to the joint member to be raised or lowered along that surface. For example, the curvature of these surfaces may be other than circular such as elliptical and change over the length. In one form, there is a gradual increase in the radius from the respective distal ends 33 and 34 of the lateral portions 22, 23 towards the distal end of the spacers 24 and 25.

Figure 6:
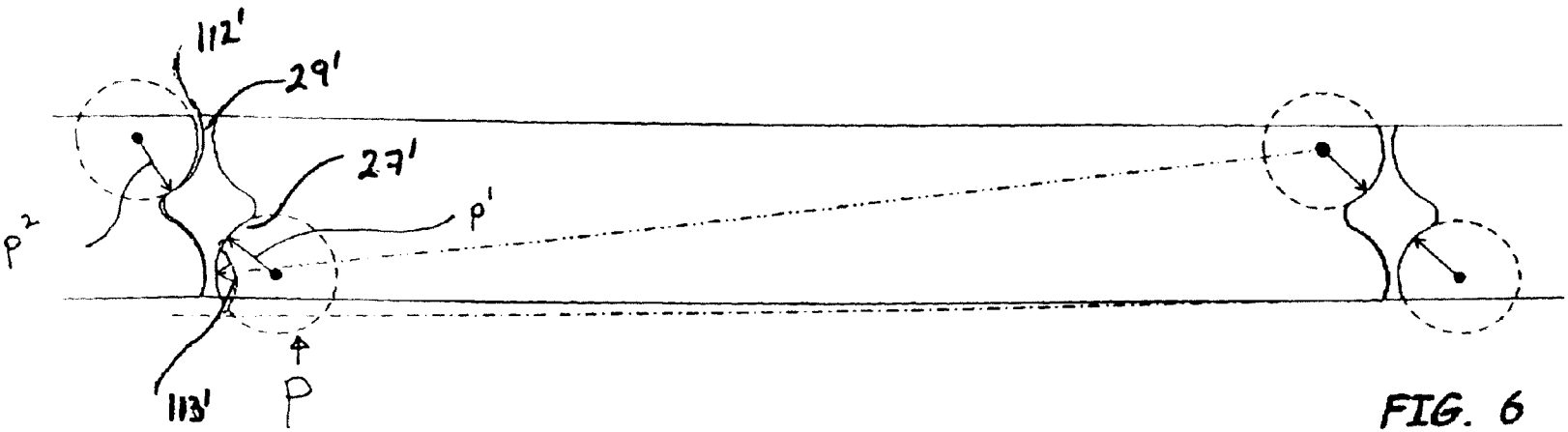
FIG. 6 is the pavement of FIG. 5 when subjected to an out-of-plane action.

Turning to FIG. 6, the pavement 100 is shown displaced after the application of an out-of-plane action P, such as may occur through tree root invasion under slab 104.

Following the application of the force P to the slab 104, the load in that slab is transferred both to the slab 103 and to slab 105 through the respective joints 101, 102. In particular, in relation to joint 101, the slab 103 applies loading to the joint member $\mathbf{20}^1$ through the bearing surface $\mathbf{27}^1$ as represented by the arrow $p^1$ and a reaction force $p^2$ is induced in its diagonally opposite bearing surface $\mathbf{29}^1$ by the other slab 103. As such, the shear means formed by the core 21 and lateral portions 22 and 23 of joint member $\mathbf{20}^1$ transfers shear between the slabs 103 and 104 across the joint 101.

Again, if the load P is of sufficient magnitude, the slab 104 will lift. This lifting action will reduce the magnitude of the load and as such, this slab will continue to lift until such time as an equilibrium position is reached. This lifting action is not planar but rather is accommodated through the hinge mechanisms incorporated in the joints 101 and 102 that result in rotation of the slab 104. As such, again the threshold loading under which the slab 104 will lift is in part a function of the resistance provided to rotation through the joints 101 and 102 particularly as shear is able to be transferred to adjoining slabs so that individual slabs are not free to lift independently of one another.

To enable the slab 104 to lift through rotation (in a clockwise direction as illustrated in FIG. 6) the hinges $\mathbf{39}^1$ and $\mathbf{39}^2$ become activated with the bearing surfaces $\mathbf{113}^1$ and $\mathbf{112}^2$ of the slab 104 moving across the bearing surfaces $\mathbf{27}^1$ and $\mathbf{29}^2$. With this movement, there is also a corresponding movement of the bearing surface $\mathbf{112}^1$ of slab 103 moving across bearing surface $\mathbf{29}^1$.

With this movement, as illustrated in FIG. 6, there is a tendency for the bearing surfaces $\mathbf{112}^1$ and $\mathbf{29}^1$ to come apart. The inventors have found that under increased angular displacement the joint member 20 may actually "flip" whereby in the context of the embodiment of FIG. 6, the bearing surface $\mathbf{27}^1$ moves out of contact with the bearing surface $\mathbf{113}^1$ of slab 104 and moves so that the bearing surface $\mathbf{29}^1$ moves into contact with the bearing surface $\mathbf{112}^1$ of slab 103. With the action, the joint member 20 acts as a rocker.

Under this angular rotation, there is effective lengthening of the slab 104. This rotation causes a closing up of the gap between the slabs 103 and 104 at the lower end of the joint 101 and a closing up of the gap between the slabs 104 and 105 of the upper end of the joint 102. Conversely, the gap at the upper end of the joint 101 opens up whereas the gap at the lower end of the joint 102 closes.

This change in the gap distance between the slabs can be used to assist shear transfer across the joint 101 and 102 as the slabs are caused to pinch the joint member. Furthermore the amount and position of this "pinching force" can be modified by the radius of curvature provided in the respective bearing surfaces. In general, the pinching force is designed so that it is not greater than that which would cause damage to the slab or the joint member.

Accordingly, under this operation the pavement 100 again effectively articulates about its respective joints so as to accommodate the out-of-plane action. Through this articulation movement, there is minimal vertical differential movement at the joints 101, 102 between the adjoining slabs. The likelihood of damage to the slabs is greatly reduced as the joints 101 and 102 are able to accommodate the rotation which effectively relieves the stress induced by this out-of-plane action P.

It is to be appreciated that whilst the above embodiments illustrate the pavement slabs 103, 104 and 105 of the pavement being cast in-situ, it will be appreciated that those slabs could be provided as pre-formed elements.

Figure 7:
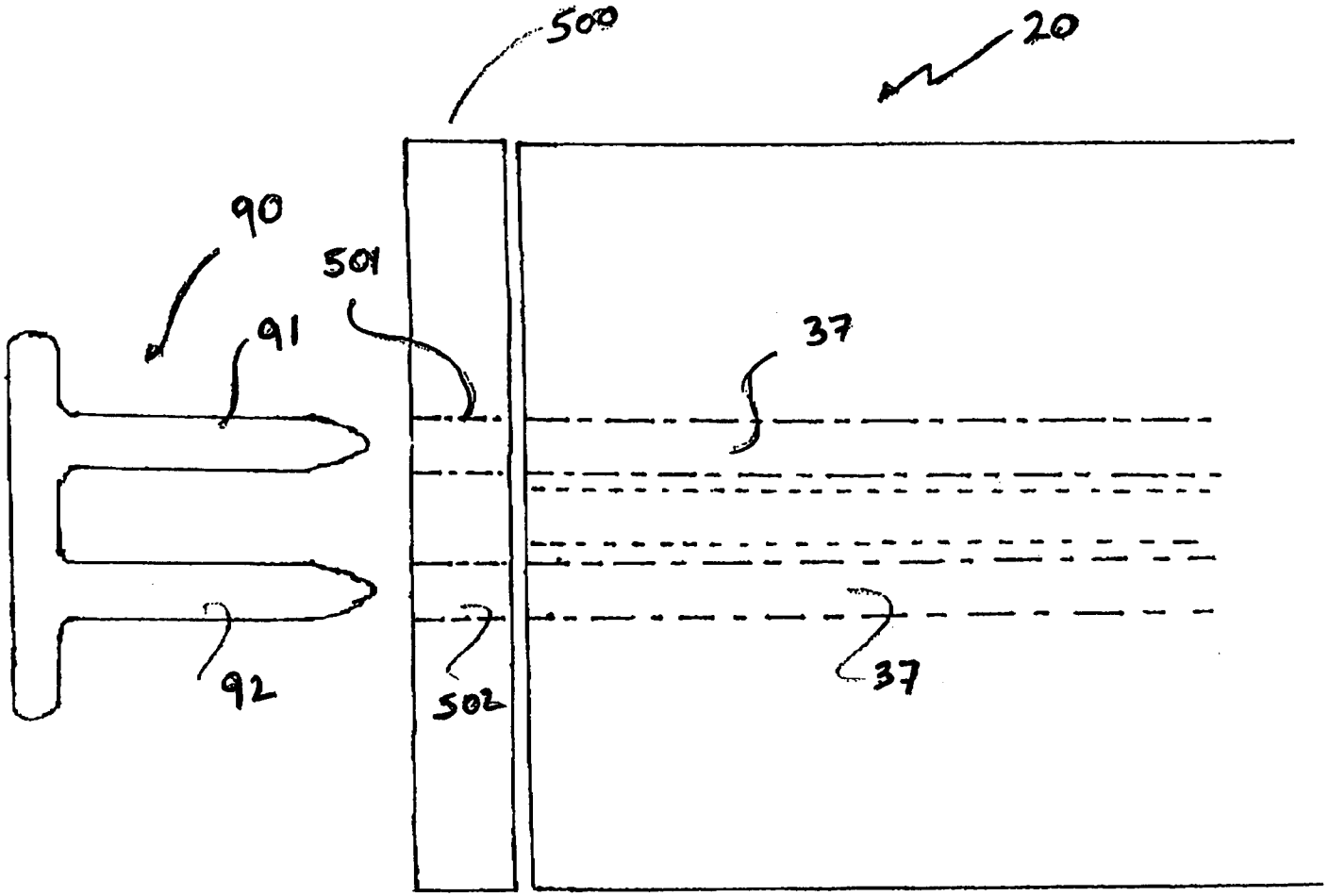
FIG. 7 is a schematic view to an enlarged scale of a connection detail of the joint member of FIG. 4.

FIG. 7 shows a side view of the joint member 20 during installation. The joint member 20 incorporates voids 37 and bears against a face of the formwork 500 such that voids 37 of the joint member 20 align with the voids 501, 502 in the formwork 500. A peg 90 is then able to be inserted into the aligned holes. The peg 90 includes prongs 91, 92 that locate in aligned formwork voids and joint member voids. The pegs stabilise and support the joint member to inhibit it moving during a concrete pour. On curing of the concrete, the pegs are removed, and the formwork stripped leaving the contiguous slabs linked and separated by the joint members.

As will be appreciated, other methods can be utilised to support the joint member during casting. For example:

Steel pegs are used and driven through near vertical pre-drilled holes in the joint member. The joint member may be laid in an excavated trench and pegs are driven into the earth holding the joint member in place;

A "notched inserter tool" is used which goes over the top of the joint member and drives the joint member into the wet concrete; or An "inserting tool" is used which captures the top of the joint member by means of a number of "cams" that are tuned and locked on to the joint member holding the joint member in place.

Figure 8:
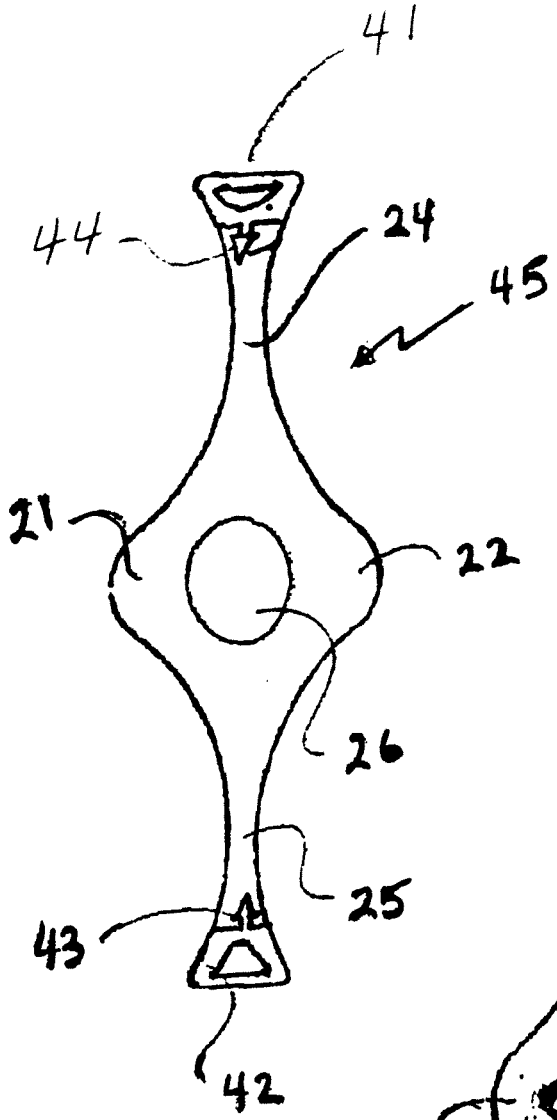
FIG. 8 is a variation of the joint member of FIG. 4.

FIG. 8 shows a further embodiment of the joint member 20. The joint member 45 shown in FIG. 8 shares many of the features of the joint member 20 and like features have been given like reference numerals.

The joint member 45 incorporates soft end portions 41, 42. These may be soft enough to accommodate compression on installation, such that the formulation of a gap may lead to the soft end portion expanding with the formation of the gap, and so maintaining a seal. In this way the ingress of detritus into the gap is reduced. Further, at the lower portion, the soft end portions provide a compressive membrane which enables the joint member to better accommodate the lengthening effect of the slabs as they angularly displace about the joint axis.

These end portions 41, 42 may be fitted using a mechanical engagement, like a clip 43, 44. Alternatively, the end portions may be bonded to the joint member 45 using adhesive or welding. In one embodiment, the end portions and joint member may be co-extruded, providing a seamless join between the differing materials of the joint member and the end portions.

Figure 9:
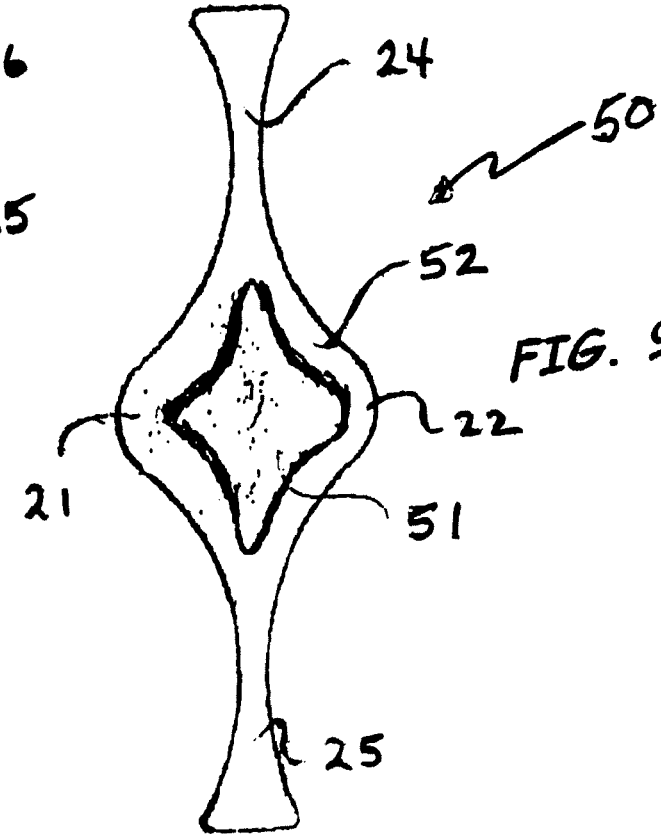
FIG. 9 is a further variation of the joint member of FIG. 4.

FIG. 9 shows a further embodiment of the joint member 50, whereby, to add further rigidity, the joint member has a rigid core 51, surrounded by a softer coating 52. The rigid core 51, such as uPVC, steel etc provides the required rigidity for installation and shear force resistance, and the outer coating of rubber, polypropylene, HDPE etc provides a positive grip with the concrete, when the joint member transfers the displacement.

Figure 10:
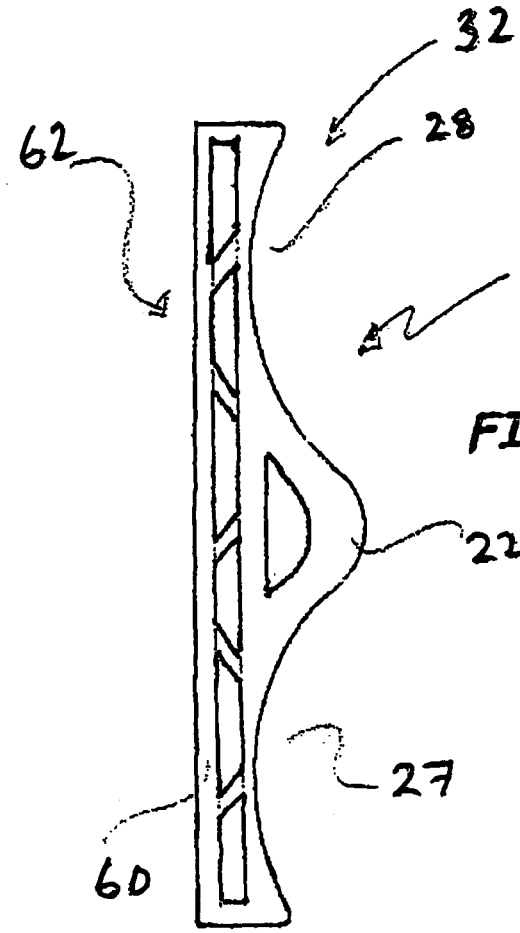
FIG. 10 is a sectional view of an expansion joint for use in the pavement of FIG. 3.
Figure 11:
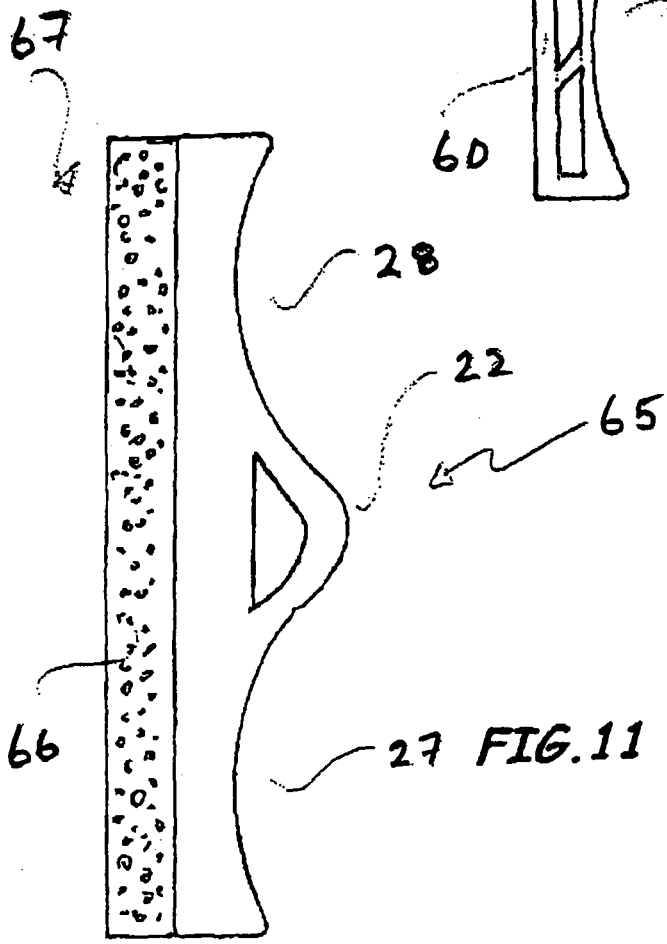
FIG. 11 is a modified version of the expansion joint of FIG. 10.

FIGS. 10 and 11 show alternative embodiments of the joint member 20 that are modified for providing expansion joints and construction joints between the contiguous slabs of the pavement. As indicated above, to permit a concrete slab to expand and contract thermally, it is common practice to include expansion joints at predetermined intervals in the pavement. To ensure a gap does not appear through movement in the horizontal plane, expansion joints have the effect of a gasket between the slabs, for movement within the plane of the slabs. The joint members 60 and 65 shown in FIGS. 10 and 11 have been modified over the joint member 20 to provide this function. Nevertheless, the members 60 and 65 include many of the features of the earlier embodiment 20, and like features have been given like reference numerals. Specifically, the joint members 60 an 65 include the lateral portions 22 and bearing surfaces 27, 28 on one face 32 of those members.

The joint members 60 and 65 include a second face 62, 67 that is generally planar so that those members may further act as partial stops for temporary cessation of construction. In conducting a partial pour of a pavement, it is beneficial to seamlessly continue the construction at a later time, either the following day, or months into the future. To ensure the process can continue smoothly, it is useful to form the desired shape in the free end of the slab, so that the new joint member can be fitted.

FIG. 10 shows the joint member 60 having an expansion portion 61 for bearing against an adjacent slab, or complimentary expansion joint. The expansion portion may be of rigid construction for acting as an end stop, or a softer material such as EPDM, to act as an expandable joint against the adjacent slab.

FIG. 11 shows a similar joint member 65 with expansion joint characteristics. In this embodiment an expansion portion 66 is bonded to the second face. In one form, the expansion portion is made from an expanded foam. Again, the expansion portion acts by bearing against an adjacent slab, or against a complimentary expansion joint.

Further, variations of the joints 101, 102 and corresponding joint members are illustrated in FIGS. 12 to 16. As the pavement construction shown in these drawings include many of the features of the earlier embodiments like features have been given like reference numerals.

Figure 12:
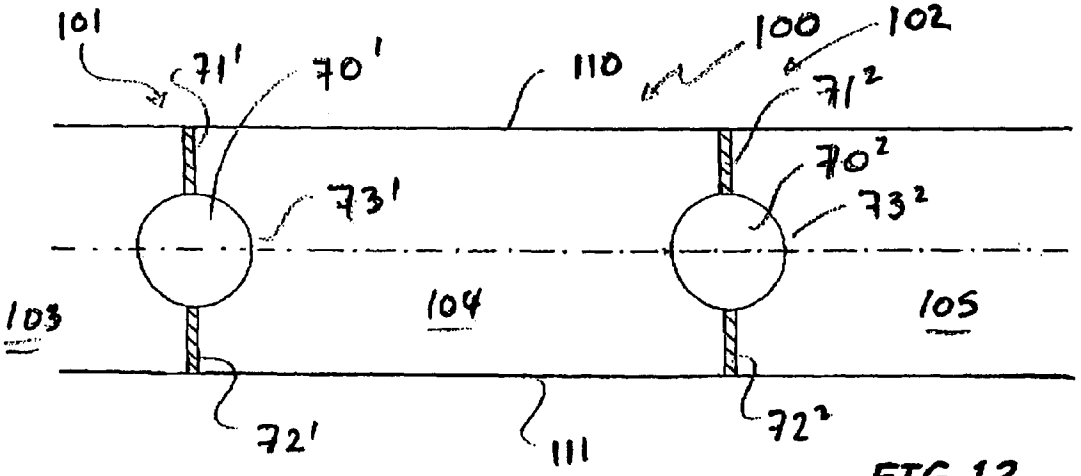
FIG. 12 is a sectional elevation view of a pavement joint incorporating a joint according to a third embodiment.

In the embodiment as illustrated in FIG. 12, the joints 101 and 102 incorporate a generally cylindrical joint member 70 which is embedded in the end surfaces of the slabs opposing the respective joints. The respective joints also include compressible members 71, 72 which extend from the cylindrical joint member 70 to the outer surfaces 110, 111 of the pavement 100.

In the embodiment of FIG. 12, the shear is able to be transferred through the joints 101, 102 through the cylindrical joint member $\mathbf{70}^1$, $\mathbf{70}^2$. In addition, the joint members are able to rotate about both joints with the outer surface $\mathbf{73}^1$ and $\mathbf{73}^2$ acting as bearing surfaces for the joint. Effective lengthening of the rotated slabs is accommodated by the compressible material 71 and 72.

Figure 13:
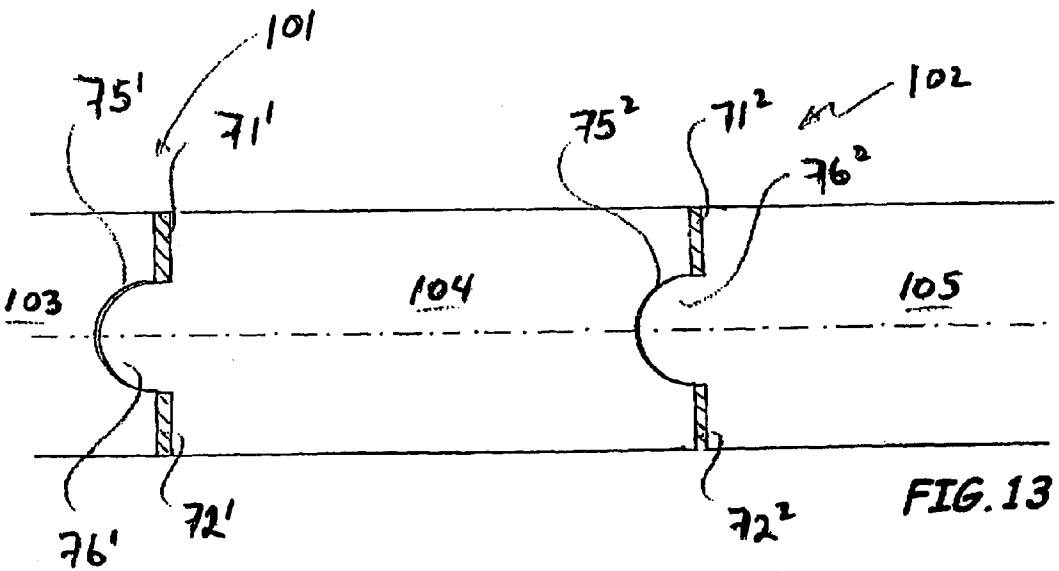
FIG. 13 is a sectional elevation view of a pavement joint according to a further embodiment.

In the embodiment of FIG. 13 a somewhat similar arrangement is disclosed as to FIG. 12 except that rather than including a specific joint member 70, a tongue and groove arrangement 75, 76 is provided at the joints 101 and 102. With this arrangement, one end surface of the slabs 103, 104 and 105 incorporate a groove 75 whereas the other end surface incorporates the tongue 76. Again compressible materials 71, 72 are provided between the slabs and extend from the tongue and groove connection to the outer surfaces of the pavement 110, 111. The tongue and groove provide arcuate engaging surfaces that allow rotation of the slabs about the connection.

Figure 14:
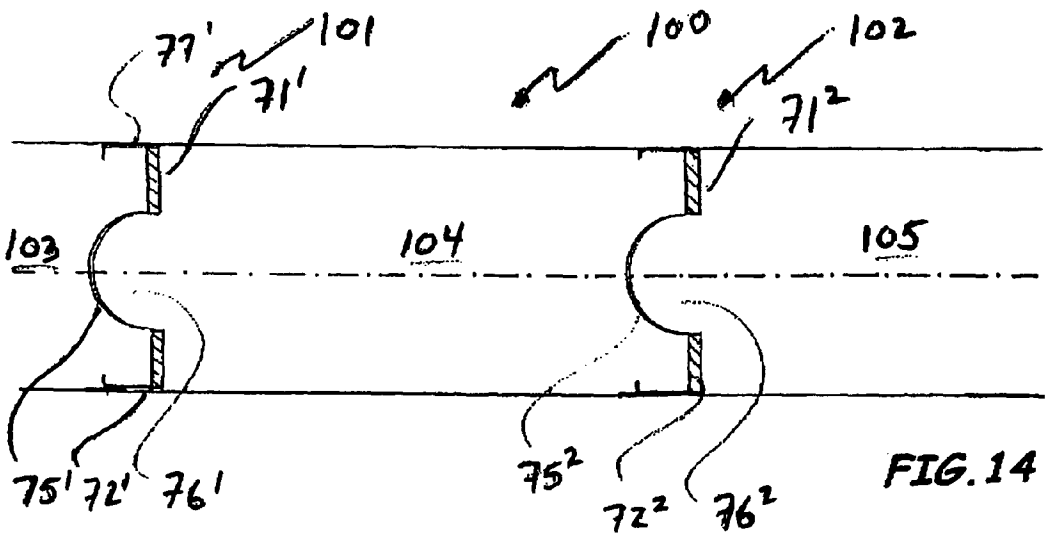
FIG. 14 is a variation of the joint of FIG. 13.

FIG. 14 shows a similar embodiment to that disclosed in FIG. 13. Again the joints 101 include a tongue and groove connection 75 and 76, compressible material 71 and 72 are provided between adjoining slabs 103, 104 and 105. In the embodiment in FIG. 14, at least one of those edge surfaces of the slab is provided with a sheet covering. In the embodiment of FIG. 14 that sheet covering is formed from steel which provides permanent formwork for casting of one edge surface of the slabs. Further, this sheet covering 77 is embedded within the cast slab so that it is secured in place. In addition, if required the compressible members 71, 72 can be applied to the outer surface of the sheet covering 77. It is to be appreciated that the arrangement of FIG. 14 could be further modified so that both surfaces incorporate a sheet covering so that the bearing surfaces within the tongue and groove connection are provided by inter-engagement of the surfaces of the sheet coverings.

Figure 15:
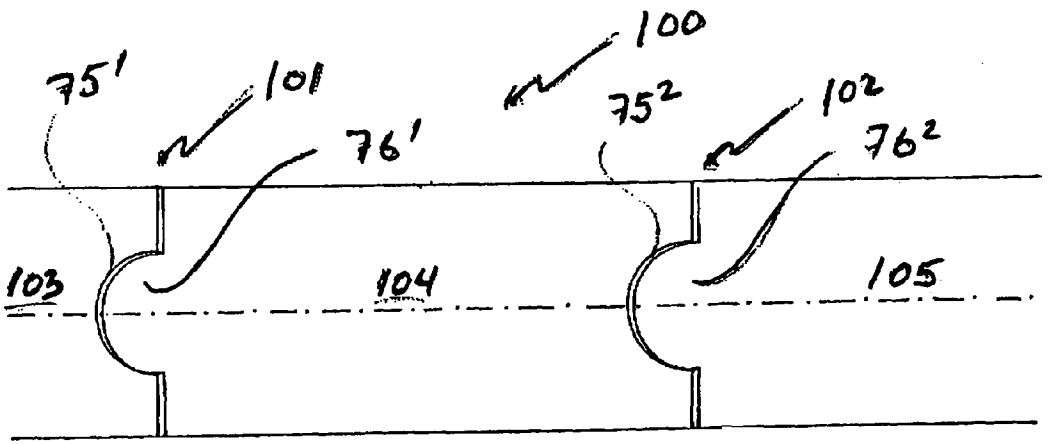
FIG. 15 is an schematic elevation view of a pavement joint according to a further embodiment.

FIG. 15 illustrates a simplified version of the joints 101, 102 as disclosed in FIGS. 13 and 14. Specifically, in the arrangement of FIG. 15, the joints 101 and 102 are formed from solely from a tongue and groove connection 75, 76. Furthermore, in the embodiment of FIG. 15 the members include a gap 78 which allows for limited angular displacement of the respective slabs.

Figure 16:
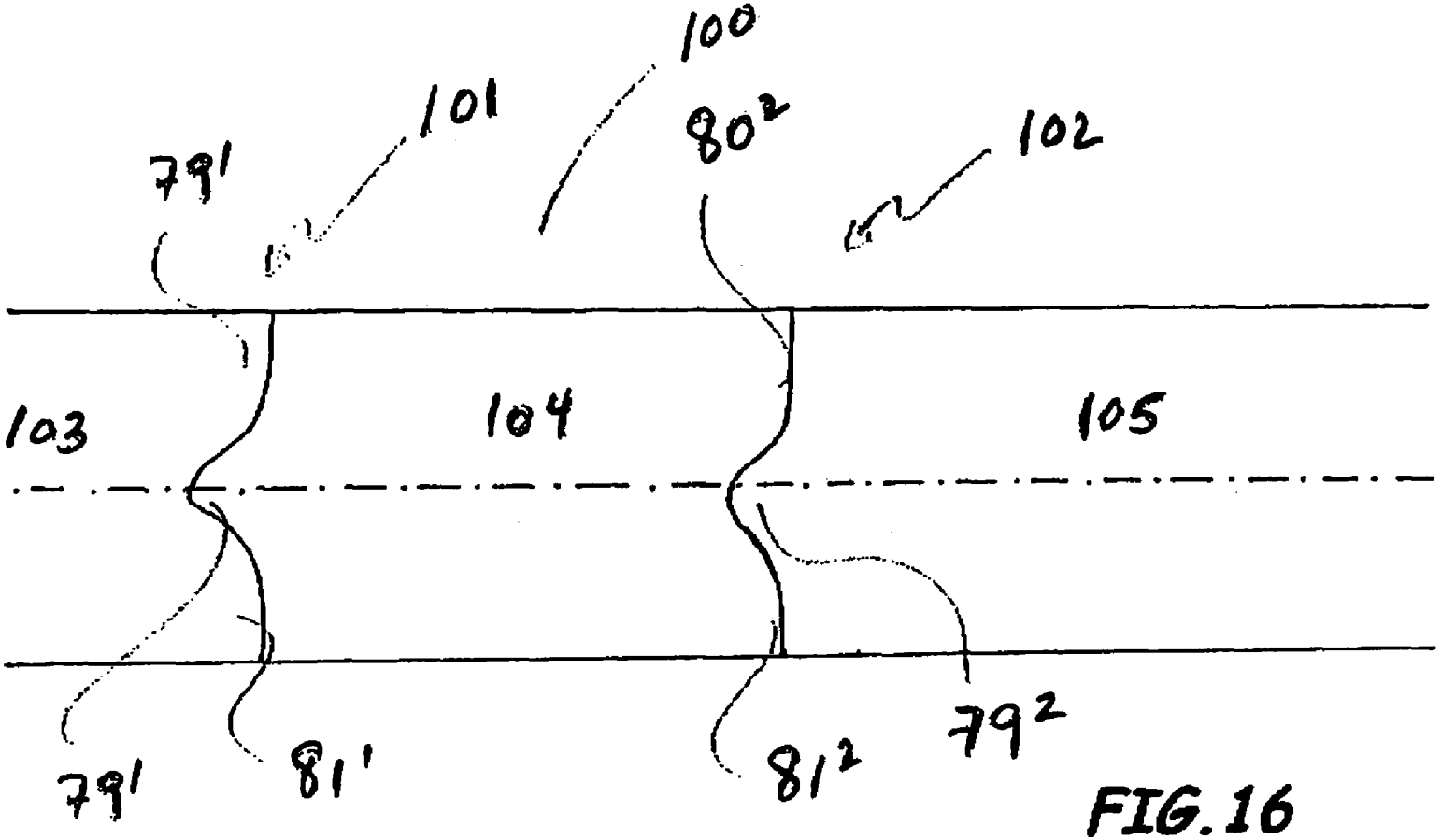
FIG. 16 is a variation of the pavement joint of FIG. 15.

FIG. 16 discloses yet a further arrangement of joint 101 and 102. In the embodiment of the FIG. 16 the end surfaces of the respective slabs 103, 104 and 105 are shaped as gear teeth which enable shear to be transferred in the manner of gear teeth, and rotation to be accommodated by rolling, in the manner of a gear wheel. As the amount of rotation that needs to accommodate a relatively small angle (typically less than 5°) in the embodiment of FIG. 16 at joint 101, the end surface of one slab 104 includes a single gear tooth 79 whilst the opposing end surface of the slab 103 is profiled to include opposite shoulders 80, 81 which allow the gear tooth 79 to roll between the shoulders 80 and 81 through the limited angular displacement.

EXAMPLES

It is convenient to illustrate the operation of various embodiments of the pavement joint with reference to the following non-limiting examples.

Example 1 (Rigid)

A full scale prototype concrete footpath was constructed at RMIT University, Melbourne, Australia. The prototype was 5 m long, 1.5 m wide and 75 mm thick. It was cast on a steel frame, designed in such a way that the formwork could be removed from underneath and so that the prototype could be jacked up from virtually any point— to simulate various scenarios of tree root invasion and soil expansion/movement. Four joint members made from rigid PVC were installed in the footpath. They were 1.5 m apart from each other thus dividing the footpath into three 1.5 m long slabs, plus two 250 mm long end slabs. The ends of the footpath were restrained by steel angles. The cross-sectional shape of the joint member was substantially as the same as shown in FIG. 4.

The prototype was cast using concrete with a nominal strength of 40 MPa. Prior to casting, the slump of the concrete was measured at 90 mm. All tests were conducted after the cylinder strength of concrete of slabs exceeded 20 MPa. The 7 day mean compressive strength of the concrete was found to be 22.9 MPa.

A series of tests was conducted on the prototype, with both concentrated and distributed loads ranging from 0 to 490 kg, applied at different locations, to assess differential displacement between slabs.

Figure 17:
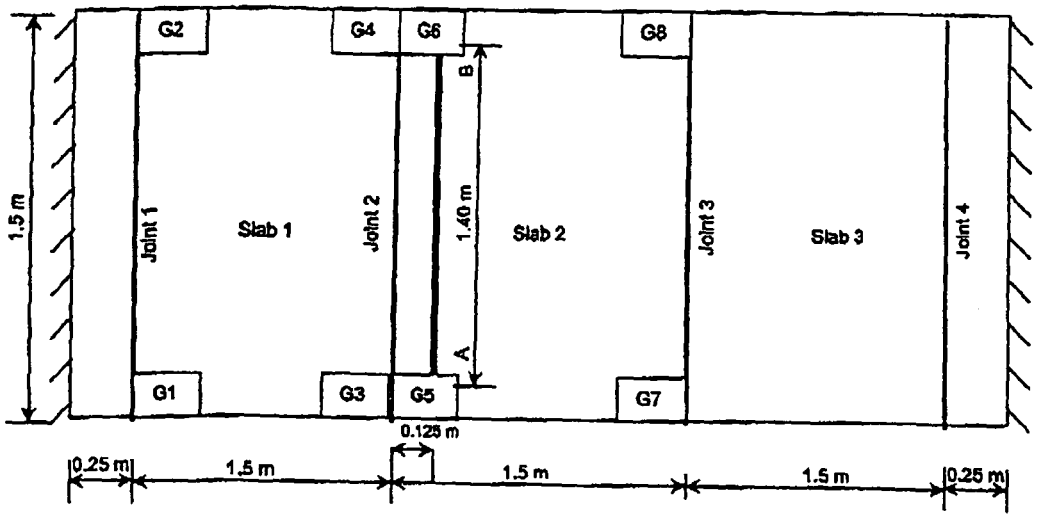
FIG. 17 is a schematic plan view of a pavement testing rig.

First, the slabs were pushed up from underneath using a long piece of solid timber, a timber packer and a hydraulic jack. The slabs were jacked up to a maximum of approximately 50 mm, measured at the central joint. No additional load was applied to the slabs at this point. The self-weight of each slab was about 400 kg. Then, uniformly distributed loads of 200 kg, 400 kg and 490 kg were added to Slab 1. The layout of the test is shown in FIG. 17.

As the slabs were jacked up, the displacements at the locations G3 to G6 were recorded by LVDT's. The displacements at the locations G1, G2, G7 and G8 were negligible. The maximum differential displacement without additional load on the slabs was 0.73 mm. The maximum displacement when 490 kg of distributed load was put on Slab 1, as shown in FIG. 3, was 2.03 mm.

In a 'worst case scenario' slab 2 was jacked up close to point G6 while a 200 kg concentrated load was applied to slab 1 close to point G4. The maximum differential displacement at point G6 was 2.49 mm.

When a slab was jacked up and no additional load was applied to the pavement, the joint member acted as if attached to jacked slab. As load was added, at a certain point, the member flicked across to the other slab. It is felt that this indicates that the member acts as a rocker; a double hinge having a short range of rotation and which acts so as to distribute localised stresses favourably.

No distress was observed in the concrete in any of the above tests.

Example 2 (Flexible)

A full scale prototype concrete footpath similar to that described in Example 1 was constructed at RMIT University, Melbourne, Australia. Four joint members made from EPDM (Ethylene Propylene Diene Monomer) rubber were installed at the same spacings as Example 1. Their shape was substantially as shown in FIG. 1. All tests were conducted after the concrete had been cured for more than 28 days. The 28 day mean compressive strength of the concrete was 21.2 MPa.

Figure 18:
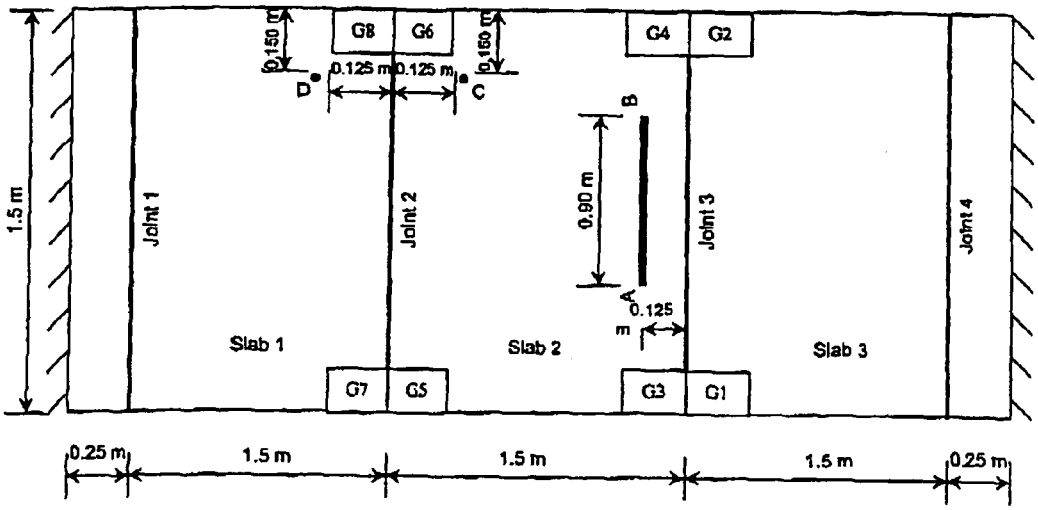
FIG. 18 is a schematic plan view of another pavement testing rig.

A series of tests similar to those described in Example 1 was carried out. In the first, the concrete slabs were jacked up from the bottom of Slab 2 along line AB (refer to FIG. 18). No additional load was applied to any of the slabs. The maximum average differential displacement on joint 3 was 3 mm.

At a maximum distributed load on slab 3 of 490 kg, the maximum average differential displacement at joint 3 was 3.5 mm. In the worst case scenario, with slab 1 jacked up at point C and a point load of 200 kg applied at point D, the differential displacement at joint 2, measured close to point G8, was 5.8 mm.

No distress was observed in the concrete in any of the above tests.

Accordingly, the present invention provides pavement joints, joint members and profiled slabs that allow a load transfer mechanism that inhibits differential vertical movement of slabs when at least one of those slabs is affected by an out-of-plane action. This load transfer mechanism is provided by the shear key which provides a means for transferring or equalising vertical displacement between the slabs. In addition one or multiple hinges are provided within the joint to provide a means of accommodating angular displacement relative to the joint axis so as to provide a mechanism whereby the pavement may articulate to relieve stress induced by the out-of-plane action. The joints may incorporate joint members which locate between contiguous slabs or may be formed from a profile of the slabs themselves.

The joint has widespread application for pavements of different types. These pavements may be formed from slabs which are cast in-situ or may be constructed using preformed components or by a combination of both. The pavements may be used for light traffic such as footpaths or sidewalks or may find application in heavier traffic environments such as on roadways or the like.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

Variations and modifications may be made to the parts previously described without departing from the spirit or ambit of the invention.

The invention claimed is:

1. A pavement joint disposed between two adjacent pavement slabs having respective edge surfaces facing each other, the joint further comprising:

an elongate joint member disposed between the facing edge surfaces of the pavement slabs and extending along a joint axis, the member comprising:

a core;

first and second lateral portions that project laterally from the core and interengage with the edge surfaces of the respective slabs, the core and the lateral portions being sufficiently unyielding in the vertical direction to form a shear key so that when at least one of the slabs is subjected to vertical out-of-plane action, the shear key transfers shear load from the one slab to the other slab to cause the slabs to move vertically together, the lateral portions being rotatably flexible about the joint axis to form a hinge between the slabs so that when at least one of the slabs is subjected to out-of-plane movement the hinge accommodates angular displacement of the slabs relative to the joint axis; and spacers extending from the core and disposed between the edge surfaces of the slabs, the spacers extending toward upper and lower surfaces of the slabs, the spacers being deformable so as to accommodate movement of the edge surfaces toward each other under angular displacement of the slabs to thereby avoid pinching of the edge surfaces of the slabs.

2. The pavement joint of claim 1, wherein the spacers extend substantially to the upper and lower surfaces of the slabs.

3. A pavement joint according to claim 1, wherein the joint member is formed from polymeric material.

4. A pavement joint according to claim 1, joint member permits a shear load of 400 kg to be transferred between the slabs under rotation of each slab of up to at least 1° whilst limiting the relative vertical displacement of the slabs to 6 mm or less.

5. A pavement joint according to claim 1, wherein the joint member permits a shear load of 400 kg to be transferred between the slabs under rotation of each slab of up to at least 2° whilst limiting the relative vertical displacement of the slabs to 6 mm or less.

6. A pavement joint disposed between two adjacent pavement slabs having respective edge surfaces facing each other, the joint further comprising:

an elongate joint member disposed between the facing edge surfaces of the pavement slabs and extending along a joint axis, the member comprising:

a core;

first and second lateral portions that project laterally from the core and interengage with the edge surfaces of the respective slabs, the core and the lateral portions being sufficiently unyielding in the vertical direction to form a shear key so that when at least one of the slabs is subjected to vertical out-of-plane action, the shear key transfers shear load from the one slab to the other slab to cause the slabs to move vertically together, thereby inhibiting differential vertical movement of the slabs wherein the lateral portions are arcuate and slidingly engage with respective arcuate edge surfaces of the slabs to form a hinge between the slabs so that when at least one of the slabs is subjected to out-of-plane movement the hinge accommodates angular displacement of the slabs relative to the joint axis; and spacers extending from the core and disposed between the edge surfaces of the slabs, the spacers extending toward upper and lower surfaces of the slabs, the spacers being deformable so as to accommodate movement of the edge surfaces toward each other under angular displacement of the slabs to thereby avoid pinching of the edge surfaces of the slabs.

7. A pavement joint according to claim 6, wherein the joint member separates the adjacent slabs with the upper end of the joint member disposed at an upper surface of the slabs and the lower end disposed at a lower surface of the slabs.

8. A pavement joint according to claim 6, wherein the joint member permits a shear load of 400 kg to be transferred between the slabs under rotation of each slab of up to at least 1° whilst limiting the relative vertical displacement of the slabs to 6 mm or less.

9. A pavement joint according to claim 6, wherein the joint member permits a shear load of 400 kg to be transferred between the slabs under rotation of each slab of up to at least 2° whilst limiting the relative vertical displacement of the slabs to 6 mm or less.

10. A pavement joint according to claim 6, wherein the joint member permits a shear load of 400 kg to be transferred between the slabs under rotation of each slab of up to at least 1° whilst limiting the relative vertical displacement of the slabs to 6 mm or less.

11. A pavement joint according to claim 6, wherein the joint member permits a shear load of 400 kg to be transferred between the slabs under rotation of each slab of up to at least 2° whilst limiting the relative vertical displacement of the slabs to 6 mm or less.

12. A pavement joint disposed between two adjacent pavement slabs having respective edges facing each other, each of the edges including arcuate edge surfaces, the joint further comprising:

an elongate joint member disposed between the adjacent slab edges and extending along a joint axis, the joint member having upper and lower ends and opposite first and second faces that face toward respective edges of the slabs and extend between said ends;

each said face incorporating an outwardly extending lateral portion, the joint member in the region of the lateral portions being sufficiently unyielding in the vertical direction to form a shear key so that when one of the slabs is subjected to vertical out-of-plane action the shear key transfers shear load from the one slab to the other slab to cause the slabs to move vertically together;

each of the elongate member faces further including arcuate bearing surfaces that extend from the lateral portion of that face towards respective upper and lower ends of the joint member;

the joint member being engaged with the edges of the adjacent slabs with interengagement of the lateral portions with the edges of the slabs and the arcuate bearing surfaces slidably engaging with the respective arcuate edge surfaces of the slabs thereby forming upper and lower hinges disposed respectively above and below the shear key and operative to accommodate angular displacement of the slabs relative to the joint axis with one hinge accommodating angular displacement of the slabs about the joint axis in one direction and the other hinge accommodating angular displacement of the slabs about the joint axis in the opposite direction.

13. A pavement joint according to claim 12, wherein the joint member separates the adjacent slabs with the upper end of the joint member disposed at an upper surface of the slabs and the lower end disposed at a lower surface of the slabs.

14. A pavement joint according to claim 12, wherein the joint member permits a shear load of 400 kg to be transferred between the slabs under rotation of each slab of up to at least 1° whilst limiting the relative vertical displacement of the slabs to 6 mm or less.

15. A pavement joint according to claim 12, wherein the joint member permits a shear load of 400 kg to be transferred between the slabs under rotation of each slab of up to at least 2° whilst limiting the relative vertical displacement of the slabs to 6 mm or less.

16. A pavement joint according to claim 12, wherein the joint member is sufficiently rigid so as not to deform on transferring shear load from the one slab to the other slab or on accommodating angular displacement of the slabs about the joint axis.

17. A pavement joint according to claim 12, wherein the bearing surfaces are concavely arcuate in cross-section for permitting relative angular displacement by sliding rotation.

18. A pavement joint according to claim 12, wherein the bearing surfaces have a constant radius.

19. A pavement joint according to claim 12, wherein the radius of curvature varies across the bearing surfaces.

20. A pavement joint according to claim 19, wherein the radius of curvature of the bearing surfaces increases from the distal end of the lateral portions towards the upper and lower ends of the joint member.

21. A pavement joint according to claim 12, wherein the joint member is formed from polymeric material.

22. A pavement joint according to claim 12, wherein the pavement joint has a neutral axis and the lateral portions are disposed on the neutral axis and the upper and lower hinges are spaced from, and disposed on opposite sides of, the neutral axis.

23. A pavement joint according to claim 19, wherein the radius of curvature of the bearing surfaces increases from the distal end of the lateral portions towards the upper and lower ends of the joint member.

* * * * *